United States Patent [19]

Iida

[11] Patent Number: 4,790,275

[45] Date of Patent: Dec. 13, 1988

[54] FUEL SUPPLY CUT-OFF CONTROL SYSTEM FOR ENGINE OF AN AUTOMOTIVE VEHICLE

[75] Inventor: Masamichi Iida, Hiroshima, Japan

[73] Assignee: Mazda Motor Corporation, Hiroshima, Japan

[21] Appl. No.: 147,697

[22] Filed: Jan. 25, 1988

[30] Foreign Application Priority Data

Jan. 27, 1987 [JP] Japan ..... 62-15157

[51] Int. Cl.[4] ..... F02D 41/12; F02D 5/02

[52] U.S. Cl. ..... 123/325; 123/493

[58] Field of Search ..... 123/325, 493; 364/431.08, 924.1; 74/866

[56] References Cited

U.S. PATENT DOCUMENTS

| | | | |
|---|---|---|---|
| 4,493,300 | 1/1985 | Hasagawa | 123/325 |
| 4,510,902 | 4/1985 | Tsuchida et al. | 123/325 |
| 4,527,521 | 7/1985 | Hasagawa et al. | 123/493 |
| 4,539,643 | 9/1985 | Suzuki et al. | 123/325 |
| 4,558,672 | 12/1985 | Boccadoro et al. | 123/325 |
| 4,565,174 | 1/1986 | Suzuki et al. | 123/493 |
| 4,597,370 | 7/1986 | Yasuoka et al. | 123/493 |
| 4,628,883 | 12/1986 | Kataoka | 123/493 |
| 4,656,988 | 4/1987 | Fukuba et al. | 123/493 |
| 4,696,278 | 9/1987 | Ito et al. | 123/493 |
| 4,714,064 | 12/1987 | Imazu | 123/325 |

FOREIGN PATENT DOCUMENTS

| | | | |
|---|---|---|---|
| 53-42854 | 11/1978 | Japan | 123/325 |
| 59-34427 | 2/1984 | Japan | 123/325 |

*Primary Examiner*—Raymond A. Nelli

*Attorney, Agent, or Firm*—Burns, Doane, Swecker & Mathis

[57] ABSTRACT

A system for cutting off the supply of fuel to an automobile engine in a specific operating region within the deceleration region of the engine determines whether the engine transmission is manual or automatic. The system has for each of the manual transmission and automatic transmission, a fuel cut-off rpm at which the supply of fuel is cut off when sensed engine rpm is greater than the fuel cut-off rpm, and a fuel restoration rpm, which is set to be less than the fuel cut-off rpm, at which the fuel supply is resumed when sensed engine rpm is less than the fuel restoration rpm. The system sets, as the specific operating region in which the supply of fuel is cut off, a region in which engine rpm is greater than the fuel cut-off rpm and engine load is less than prescribed, changes over the fuel cut-off rpm and the fuel restoration rpm between that for the manual transmission and that for the automatic transmission in dependence upon the determination, and sets the width between the fuel cut-off rpm and fuel restoration rpm for the automatic transmission to be greater than the width between the fuel cut-off rpm and fuel restoration rpm for the manual transmission.

11 Claims, 5 Drawing Sheets

FUEL SUPPLY CUT-OFF CONTROL SYSTEM FOR ENGINE OF AN AUTOMOTIVE VEHICLE

BACKGROUND OF THE INVENTION

This invention relates to a system for cutting off the supply of fuel to the engine of an automotive vehicle in a specific operating region within the deceleration region of the engine.

By way of example, an internal combustion engine fuel supply control method disclosed in the specification of Japanese Patent Publication (KOKOKU) No. 53-42854 is known generally as one method of cutting off the supply of fuel to an engine in a specific operating region of the engine. In accordance with the fuel supply control method disclosed in this known art, fuel cut-off rpm of the engine is set to be higher than the fuel restoration rpm and, as a result, a prescribed width (hysteresis) is provided between the fuel cut-off rpm and fuel restoration rpm. By setting hysteresis in this manner, the occurrence of so-called "hunting" between the fuel cut-off state and fuel restoration state is prevented.

However, the hysteresis set is a prescribed, fixed value. Consequently, problems arise when it is attempted to apply this control method uniformly to a manual-type transmission, in which the output shaft of the engine and the wheels of the vehicle are mechanically connected, and to an automatic-type transmission, which has a torque converter connecting the engine output shaft and the vehicle wheels in a state that allows relative rotation between them. The aforementioned problems will now be described.

The original purpose of fuel cut-off control is to improve fuel economy, i.e. to reduce fuel consumption. Accordingly, it is required that the fuel cut-off region be set to have a large width in order to assure an improvement in fuel economy. Here the fuel restoration rpm must be set a prescribed width greater than the idling rpm in order to avoid stalling of the engine. To achieve this, it is preferred in view of improving fuel economy that the fuel cut-off rpm be set to an rpm slightly higher than the fuel restoration rpm in a state where the fuel cut-off rpm is extremely close to the fuel restoration rpm. In other words, hysteresis should be set small in order to improve fuel economy.

The fact that hysteresis is small does not lead to problems in a manual-type transmission in which the engine and wheels are connected in a state which does not allow slipping when the engine is in a cruising condition. However, problems do arise in an automatic-type transmission in which the engine and wheels are connected in a state which does allow the aforementioned slipping when the engine is in a cruising condition.

Specifically, when the engine rotational speed or rpm drops in a state where the fuel has been cut off, the supply of fuel is resumed at the moment engine rpm attains the fuel restoration rpm. This restoration of the supply of fuel is accompanied by a sudden rise in engine rpm. Since the hysteresis is set small, this rise in engine rpm causes engine rpm to again rise above the fuel cut-off rpm, as a result of which the fuel cut-off state is established. Accordingly, the supply of fuel is cut off and engine rpm begins to decline. Thus, the rotational speed of the engine exhibits the hunting phenomenon, which causes the driver to experience unease with regard to the state of engine drive.

If hysteresis is set wide in order to prevent such hunting, on the other hand, this will interfere with the attainment of the aforementioned objective, namely the improvement in fuel economy.

Another problem is a high manufacturing cost, since it would be necessary to manufacture a control system for the manual-type transmission and a different control system for the automatic-type transmission.

SUMMARY OF THE INVENTION

An object of the present invention is to provide a fuel supply cut-off system for automotive engines capable of achieving optimum fuel cut-off control in a manual-type transmission and optimum fuel cut-off control in an automatic-type transmission without raising manufacturing cost.

Another object of the present invention is to provide a fuel supply cut-off system for automotive engines in which a driver will experience no unease whatsoever with regard to the state of engine drive, thereby enabling the driver to drive the vehicle without anxiety, even when the supply of fuel is cut off.

A further object of the present invention is to provide an economical fuel supply cut-off system for automotive engines which does not lead to an unnecessary rise in cost entailed by separately manufacturing a control system for manual-type transmissions and a control system for automatic-type transmissions.

According to the present invention, the foregoing objects are attained by providing a fuel supply cut-off system for an engine of an automotive vehicle, which comprises: a transmission connected to an output shaft of the engine; supply means for supplying the engine with a required amount of fuel conforming to the operating state of the engine; cut-off means for cutting off the supply of fuel by the supply means in a specific operating region of the engine, the specific operating region being a portion of a deceleration region stipulated by values relating to engine load and engine rotational speed; transmission determination means for determining whether the transmission is of a manual type, in which the output shaft of the engine and wheels of the vehicle are mechanically connected, or of an automatic type, in which the output shaft of the engine and the wheels of the vehicle are connected in a state which allows relative rotation between the output shaft and the wheels; and setting means having, for each of the manual-type transmission and automatic-type transmission, a fuel cut-off rpm at which the supply of fuel is cut off when sensed engine rpm is greater than the fuel cut-off rpm, and a fuel restoration rpm, which is set to be less than the fuel cut-off rpm, at which the fuel supply is resumed when sensed engine rpm is less than the fuel restoration rpm, the setting means setting, as the specific operating region in which the supply of fuel is cut off, a region in which engine rpm is greater than the fuel cut-off rpm and engine load is less than prescribed; the setting means changing over the fuel cut-off rpm and the fuel restoration rpm between that for the manual-type transmission and that for the automatic-type transmission in dependence upon the determination made by the determination means, and setting the width between the fuel cut-off rpm and fuel restoration rpm for the automatic-type transmission to be greater than the width between the fuel cut-off rpm and fuel restoration rpm for the manual-type transmission.

When the determination means in the automotive engine fuel supply cut-off system constructed as set forth above determines that the transmission of the engine is of the manual type, the setting means is responsive to the determination to read the fuel cut-off rpm and fuel restoration rpm for the manual-type transmission, whereby a specific operating state for the manual-type transmission is prescribed. On the other hand, if the determination means determines that the transmission of the engine is of the automatic type, the setting means is responsive to the determination to read the fuel cut-off rpm and fuel restoration rpm for the automatic-type transmission, whereby a specific operating state for the automatic-type transmission is prescribed.

Since the width between the fuel cut-off rpm and fuel restoration rpm for the automatic-type transmission is set to be greater than that between the fuel cut-off rpm and fuel restoration rpm for the manual-type transmission, optimum fuel cut-off control in the manual-type transmission and optimum fuel cut-off control in the automatic-type transmission are achieved in accordance with the determination made by the determination means.

Furthermore, in the present invention, the engine load that prescribes the specific operating region is set in the setting means to a load at which the throttle valve will be fully closed. An advantage attained as a result of this is that the engine load can be sensed in a simple manner.

In the automotive engine fuel supply cut-off system of the invention, the width between the fuel cut-off rpm and fuel restoration rpm for the automatic-type transmission is set to be greater than the amount of decrease in engine rpm at the time of fuel cut-off. Thus, the size of hysteresis preferred for diminishing hunting when the fuel is cut off at deceleration ca be set.

The fuel supply cut-off system of the invention further comprises inhibiting means for increasing an amount of intake air for a prescribed period of time immediately after the throttle valve is fully closed, supplying fuel commensurate with the amount of increase in intake air, and inhibiting fuel cut-off at least during the period of time during which the amount of intake air is being increased in a state where gears are engaged. As a result, a dashpot effect at the start of deceleration is capable of acting satisfactorily, thus making it possible to lessen the deceleration shock sustained by the vehicle body.

In the fuel supply cut-off system of the invention, the fuel restoration rpm for the manual-type transmission is set to be the same as the fuel restoration rpm for the automatic-type transmission. This makes it possible to share use of the same memory so that memory can be economized.

In the fuel supply cut-off system of the invention, the fuel restoration rpm for the automatic-type transmission is set to be greater than the fuel restoration rpm for the manual-type transmission. As a result, in the deceleration region of the vehicle equipped with the automatic-type transmission, the higher the engine rpm, the smaller the proportion of the driving force, which is for driving the engine, that is attributable to combustion of the fuel. Consequently, the hysteresis for preventing hunting can be reduced. This is advantageous in that it is possible to achieve a further reduction in hunting in an automatic-type transmission that is prone to fluctuations in engine rotational speed.

The fuel supply cut-off system of the invention further comprises inhibiting means for inhibiting the fuel cut-off when an air conditioner is not operating in a prescribed period of time immediately after the engine is started. More specifically, since the state of engine drive is unstable immediately after the engine is started, it is preferred that the vehicle air conditioner be rendered inoperative at such time. Since there is a possibility that engine rpm will rise when such is the case, the arrangement is such that fuel cut-off control will not be carried out as the engine rpm is rising. In this manner stalling of the engine immediately after it is started is reliably prevented from occurring.

The setting means of the fuel supply cut-off system is adapted to set the fuel cut-off rpm and fuel restoration rpm in dependence upon the temperature of the engine coolant, with these rotational speeds being set to higher values the lower the temperature of the coolant. As a result, though the state of engine drive is unstable at low coolant temperatures, stalling of the engine can be prevented by narrowing the fuel cut-off region. Another advantage is that warming up of the engine is facilitated.

In the automotive engine fuel supply cut-of system of the invention, the higher the fuel cut-off rpm and fuel restoration rpm are set to be, the smaller the width between the fuel cut-off rpm and fuel restoration rpm for the automatic-type transmission is set to be. In the deceleration region of the vehicle equipped with the automatic-type transmission, the higher the engine rpm, the smaller the proportion of the driving force, which is for driving the engine, that is attributable to combustion of the fuel. Consequently, the hysteresis for preventing hunting can be reduced. This is advantageous in that it is possible to suppress a fluctuation in engine rpm in the vicinity of the fuel cut-off operating region.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

One embodiment of a fuel supply cut-off system for an engine of an automotive vehicle in accordance with the present invention will now be described in detail with reference to FIGS. 1 through 5.

Figure 1:
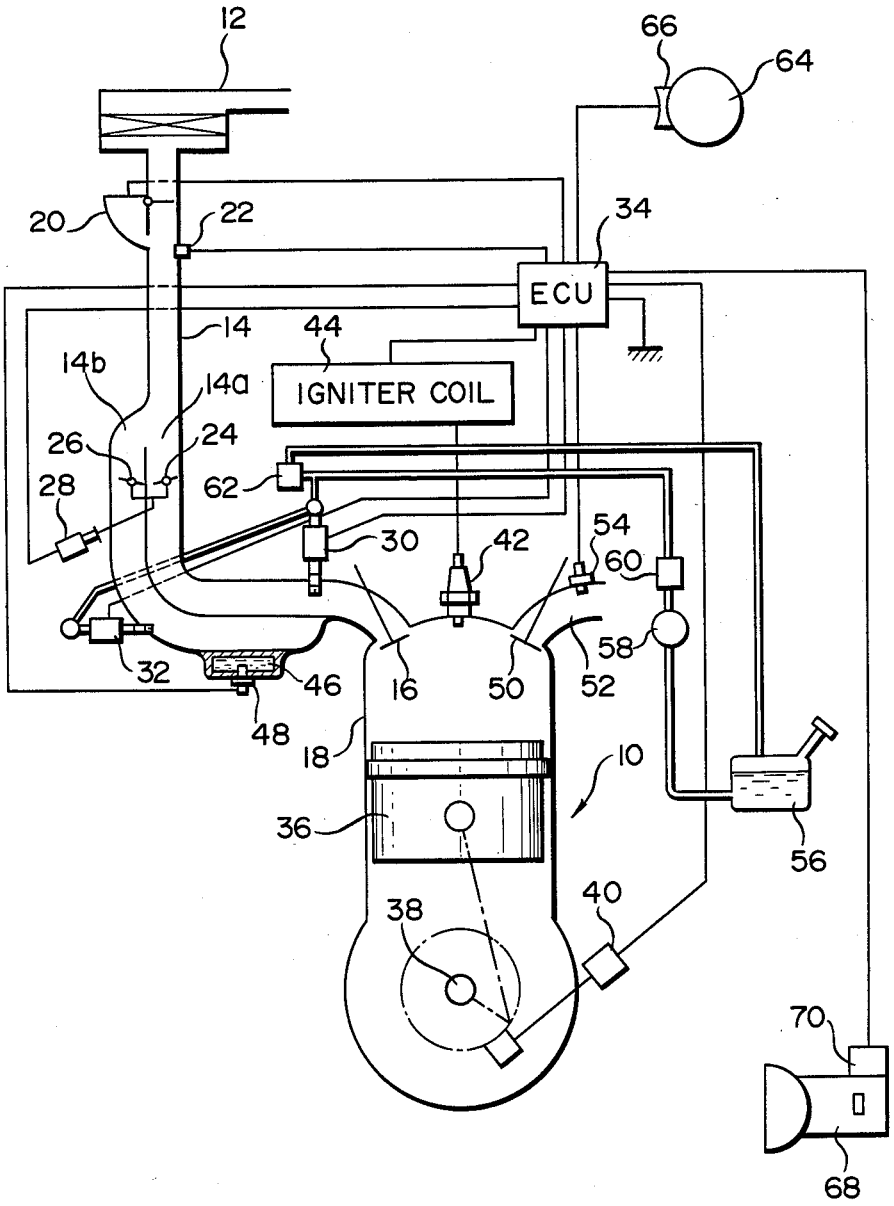
FIG. 1 is a sectional view schematically illustrating the construction of an automobile engine equipped with an embodiment of a fuel supply cut-off system according to the present invention.

As shown in FIG. 1, an engine 10 has an air filter 12 for filtering intake air. The air filtered by the air filter 12 is introduced to the interior of each cylinder 18 through a corresponding intake piece 14 and corresponding intake valve 16. Mounted on the intake pipe 14 on the upstream side thereof are an air flowmeter 20 for measuring the flow rate of the intake air that passes through the intake pipe 14, and an intake air temperature sensor 22 for measuring the temperature of the intake air.

The intake pipe 14 is divided from a point midway along its length into two passageways 14*a*, 14*b*, which are for the primary side and secondary side, respectively. A throttle valve 24 on the primary side is arranged in the primary-side passageway 14*a*, and a throttle valve 26 on the secondary side is arranged in the secondary-side passageway 14*b*. Attached to both throttle valves 24, 26 is a position sensor 28 for sensing the opening degree thereof.

The downstream sides of the two passageways 14*a*, 14*b* are connected to the corresponding cylinder 18. Arranged respectively in the passageways 14*a*, 14*b* are first (primary-side) and second (secondary-side) fuel injection valves 30, 32 for feeding fuel into the corresponding cylinder 18. The fuel injection valves 30, 32 are made to regulate the fuel injection pulse width by an engine control unit (hereinafter referred to simply as an "ECU") 34, described below, in dependence upon the state of the load of engine 10, etc.

A piston 36 is arranged to slide freely inside each cylinder 18. Each piston 36 reciprocates slidingly within the cylinder 18, thereby rotating a crankshaft 38 connected thereto. Provided near the crankshaft 38 is a crank angle sensor 40 which senses when the crankshaft 38 passes by. Thus, each full revolution of the crankshaft 38 is sensed by the crank angle sensor 40.

Provided on the upper portion of each cylinder 18 is a spark plug 42 for burning the fuel injected into the cylinder. The spark plug 42 is connected to the ECU 34 via an igniter coil 44. Each of the intake air passageways 14*a*, 14*b* is provided with a coolant water passageway 46 for cooling these intake air passageways. The coolant water passageway 46 has a water temperature sensor 48 attached thereto for sensing, as engine temperature, the temperature of the coolant water passing therethrough.

The fuel burned inside each cylinder 18 is exhausted into the atmosphere as exhaust gas through a corresponding exhaust valve 50 and exhaust pipe 52. A catalytic converter (not shown) for purifying the exhaust gas is provided in the exhaust pipe 52 at a point along its length. Attached to the exhaust pipe 52 is an $O_2$ sensor 54 for measuring the concentration of oxygen which remains in the exhaust gas passing through the exhaust pipe 52.

A gasoline tank 56 is connected to both of the fuel injection valves 30, 32. The gasoline in the gasoline tank 56 is taken out by a fuel pump 58 and filtered by a fuel filter 60. The filtered fuel is supplied to the fuel injection valves 30, 32 with its pressure being regulated by a pressure regulator 62.

The engine 10 has a transmission 68 provided with a determination unit 70 which determines whether the transmission is of the manual or automatic type. More specifically, the discrimination unit 70 and the ECU 34 are interconnected and the arrangement is such that the discrimination unit 70 will output a "1"-level inhibit signal to the ECU 34 when it determines that the transmission is of the manual type and a "0"-level signal when it determines that the transmission is of the automatic type.

Also connected to the ECU 34 are the air flowmeter 20, the intake air temperature sensor 22, the position sensor 28, the crank angle sensor 40, the water temperature sensor 48, the $O_2$ sensor 54 and a rotational speed (rpm) sensor 66 for sensing the actual rotational speed Ne of the engine 10 by way of a distributor 64. Thus, data and information relating to the various quantities sensed and measured are input to the ECU 34.

The ECU 34 is further connected to the primary- and secondary-side fuel injection valves 30, 32 and to the spark plug 42 and is adapted to control the drive of these elements based on the aforementioned data and information input thereto.

The specifics of control relating to the fuel cut-off operation executed by the ECU 34, which operation is a characterizing feature of the present invention, will now be described with reference to the flowcharts of FIGS. 2A and 2B and the graphs of FIGS. 3 through 5.

Figure 2A:
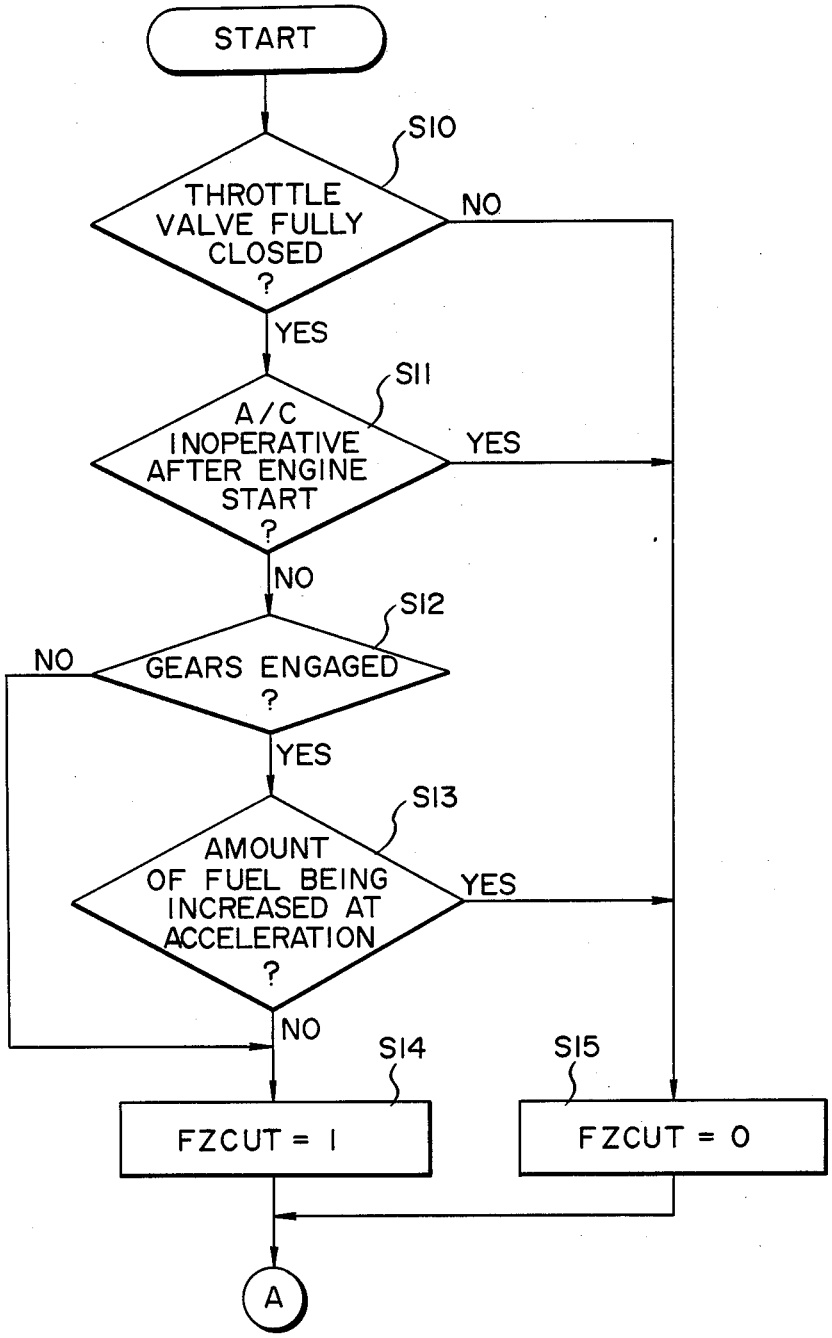
FIGS. 2A and 2B are flowcharts illustrating the control operation of an ECU.

As shown in FIG. 2A, the first step S10 of the flowchart is to determine, based on the detection information indicated by the output signal of the position sensor 28, whether the primary-side throttle valve 24 is fully closed. If the answer is YES, namely if it is determined that the primary-side throttle valve 24 is fully closed, then it is determined at a step S11 whether the vehicle air conditioner (hereinafter referred to simply as an "A/C") is inoperative after the engine 10 has been started.

If the answer received at step S11 is NO, meaning that the A/C has been determined to be in operation after engine start, then it is determined at a step S12 whether the gears of the transmission are engaged. If the answer here is YES, meaning that the gears are engaged, then the program proceeds to a step S13, at which it is determined whether the quantity of fuel at deceleration is being increased to accompany an increase in the amount of intake air for the purpose of preventing shock produced at the beginning of deceleration.

If the answer received at step S13 is NO, meaning that the quantity of fuel at deceleration is not being increased, then a fuel cut-off condition flag FZCUT is set to 1 at a step S14.

If a NO answer is received at the step S10, meaning that the primary-side throttle 24 is at least open, or if a YES answer is received at the step S11, meaning that the A/C is not operating after engine start, or if a YES answer is received at the step S13, meaning that the quantity of fuel is being increased at deceleration, then the program proceeds to a step S15, at which the fuel cut-off condition flag FZCUT is set to 0.

If a NO answer is received at the step S12, meaning that none of the gears are engaged, i.e., that the transmission is in so-called "neutral", then the program skips the step S13, at which it is determined whether the fuel is being increased at deceleration, and proceeds to the step S14, at which the fuel cut-off condition flag FZCUT is set to 1.

Thus, as a result of the foregoing, the fuel cut-off condition flag FZCUT is set to 1 or 0, in dependence upon the operating state, at the beginning of operation.

Figure 2B:
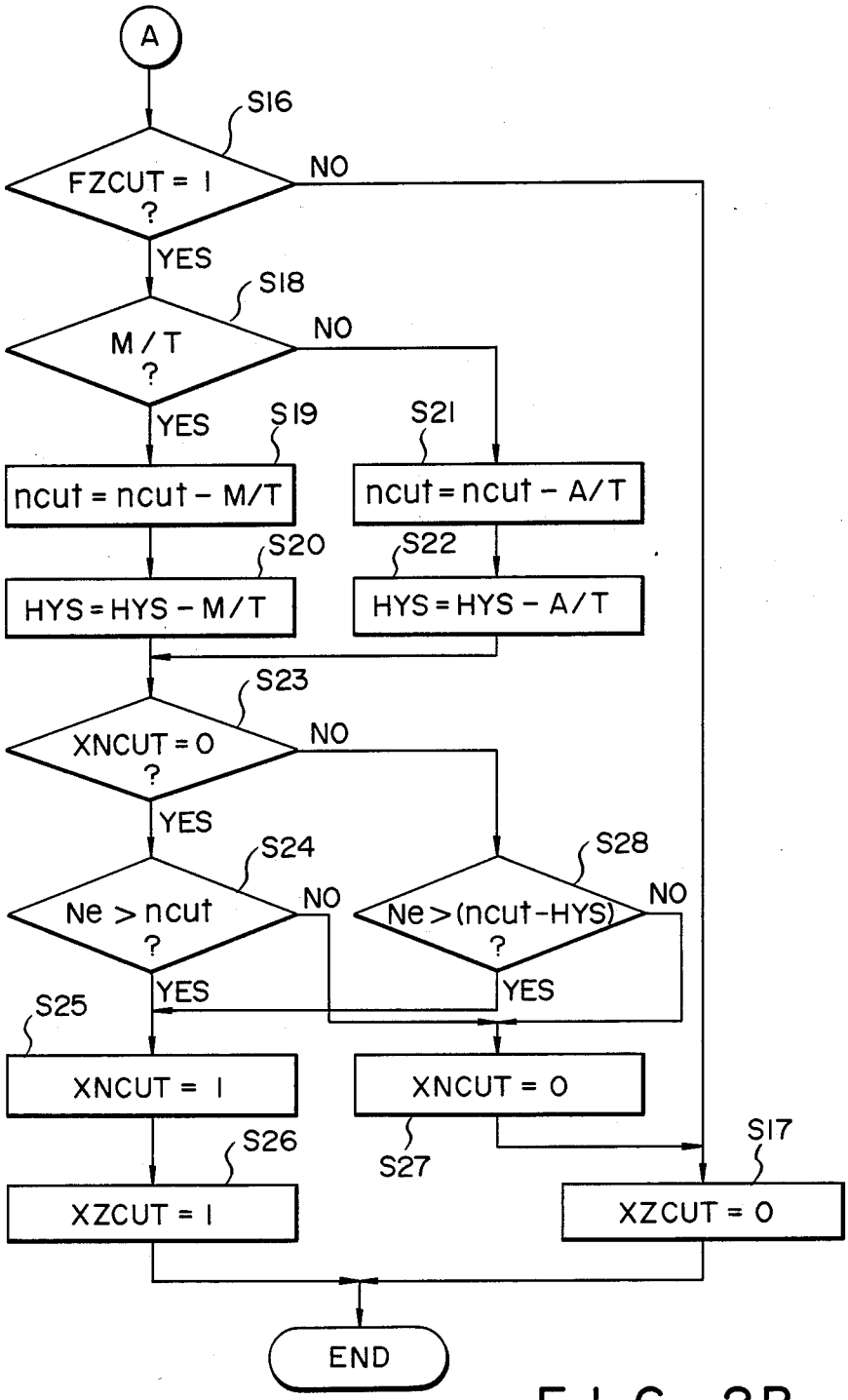

Thereafter, as shown in FIG. 2B, the program proceeds to a step S16, at which it is determined whether the fuel cut-off condition flag FZCUT is 1. If the result of the determination is NO, meaning that the fuel cut-off condition flag is 0, then the program proceeds to a step S17, at which a fuel cut-off region flag XZCUT is set to 0, thereby establishing a fuel supply mode. In other words, the arrangement is such that when the fuel cut-off condition flag FZCUT is 0, the fuel cut-off mode will not be established.

If the result of the determination at the step S16 is YES, on the other hand, indicating that the fuel cut-off condition flag FZCUT is 1, then, on the basis of the inhibit signal from the determination unit 70, it is determined at a step S18 whether the transmission 68 of the vehicle is of the manual type. If the answer here is YES, meaning that the transmission has been determined to be of the manual type, then the program proceeds to a step S19, at which a fuel cut-off rpm ncut-M/T for the manual-type transmission is read out from the set relationship shown in FIG. 3 on the basis of coolant water temperature information THW provided by the coolant water temperature sensor 48. Thus, a fuel cut-off rpm ncut is decided.

The step S19 is followed by a step S20, at which a hysteresis HYS-M/T for the manual-type transmission is read out at the same time to decide hysteresis HYS. Thus, a fuel cut-off region for the manual-type transmission is decided. As is evident from FIG. 3, a fuel restoration rpm is decided by a value obtained by subtracting hysteresis HYS from fuel cut-off rpm ncut. In the present embodiment, the fuel restoration rpm is set to be the same both for a transmission of the manual type and a transmission of the automatic type.

Figure 3:
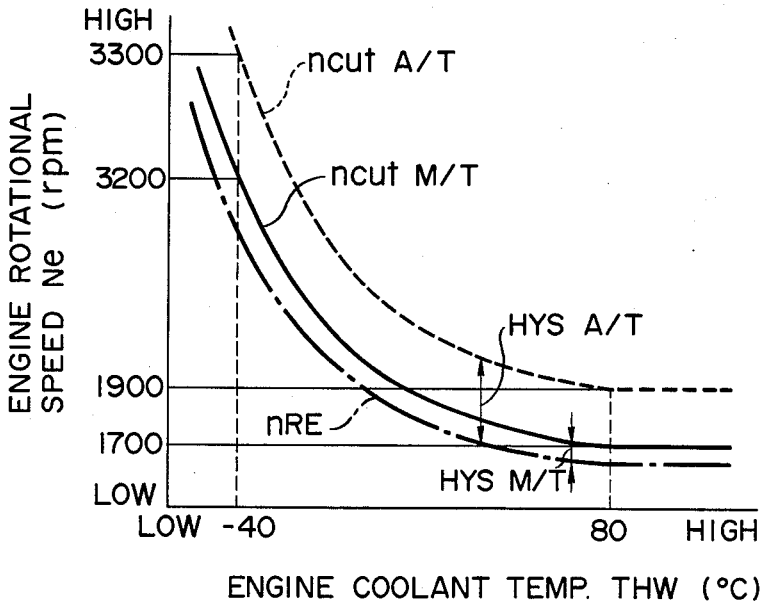
FIG. 3 is a diagram illustrating fuel cut-off rpm and fuel restoration rpm for a manual-type transmission and fuel cut-off rpm and fuel restoration rpm for an automatic-type transmission set in relation to the temperature of engine coolant water.

If the answer received at the step S18 is NO, meaning that the transmission 68 of the vehicle has been determined to be of the automatic type, then the program proceeds to a step S21, at which a fuel cut-off rpm ncut-A/T for the automatic-type transmission is read out from the relationship shown in FIG. 3 on the basis of coolant water temperature information THW. Thus, a fuel cut-off rpm ncut is decided. This is followed by a step S22, at which a hysteresis HYS-A/T for the automatic-type transmission is read out to decide hysteresis HYS. Thus, a fuel cut-off region for the automatic-type transmission is decided.

After a fuel cut-off region is thus set depending upon the type of the transmission 68, it is determined at a step S23 whether a fuel cut-off rotation switch flag XNCUT is 0. The fuel cut-off rotation switch flag XNCUT is decided as shown in FIG. 4. If the answer received at the step S23 is YES, namely that the fuel cut-off rotation switch flag XNCUT is 0, which means that the state of fuel supply is no presently being subjected to a fuel cut-off, then the program proceeds to a step S24. Here, based on the information from the engine rpm sensor 66, it is determined whether the sensed rotational speed Ne of the engine 10 is greater than the fuel cut-off rpm ncut read out at step S19 or step S21.

Figure 4:
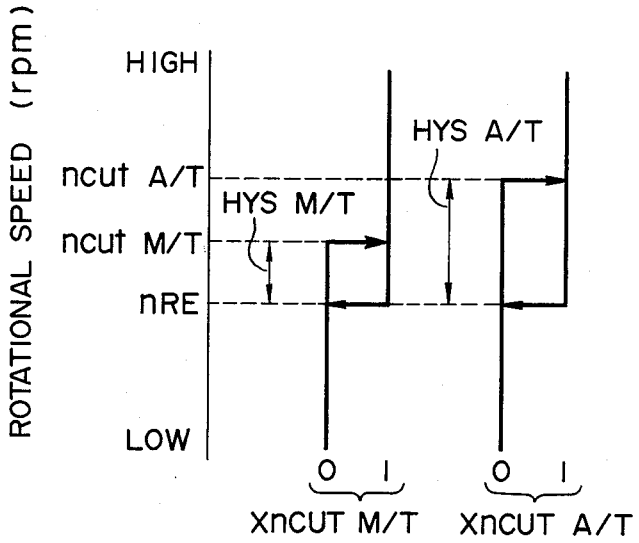
FIG. 4 is a status diagram showing a change in a fuel cut-off rotation switch flag caused by rpm.

If the answer at step S23 is YES, namely if it is determined that the present rotational speed Ne is greater than the fuel cut-off rpm ncut, then the fuel cut-off rotation switch flag XNCUT is set to 1 at a step S25, based on the conditions stipulated in FIG. 4. This is followed by a step S26, at which the fuel cut-off region flag XZCUT is set to 1, as a result of which the fuel cut-off mode is established. In other words, a transition is made to the fuel cut-off state if the present rotational speed Ne is greater than the fuel cut-off rpm ncut in a state where fuel-cut off is not presently being executed If the answer received at the step S24 is NO, meaning that the present rotational speed Ne is less than the fuel cut-off rpm ncut, then the fuel cut-off rotation switch flag XNCUT is set to 0 at a step S27. This is followed by the step S17, at which the fuel cut-off region flag ZCUT is set to 0. In other words, the fuel supply state is maintained as before if the present rotational speed Ne is less than the fuel cut-off rpm ncut in a state where fuel-cut off is not presently being executed.

If the answer received at the step S23 is NO, namely if the fuel cut-off rotation switch flag XNCUT is 1, then it is determined at a step S28 whether the rotational speed Ne of engine 10 is greater than a value obtained by subtracting the hysteresis HYS from the fuel cut-off rpm ncut read out at step S19 or step S21. If the answer received at the step S28 is YES, meaning that the present rotational speed Ne is greater than a value obtained by subtracting the hysteresis HYS from the fuel cut-off rpm ncut, then, based on the stipulated condition shown in FIG. 4, the program proceeds to the step S25, at which the fuel cut-off rotation switch flag XNCUT is set to 1. This is followed by the step S26, at which the fuel cut-off region flag XZCUT is set to 1 to establish the fuel cut-off mode.

In other words, the fuel cut-off state is maintained as before if the present rotational speed Ne is greater than a value obtained by subtracting the hysteresis HYS from the fuel cut-off rpm ncut in a state where the fuel cut-off is present being executed.

If a NO answer is received at the step S28, on the other hand, meaning that the present rotational speed Ne is less than a value obtained by subtracting the hysteresis HYS from the fuel cut-off rpm ncut, the program proceeds to the step S27, at which the fuel cut-off rotation switch flag XNCUT is set to 0. This is followed by the step S17, at which the fuel cut-off region flag XZCUT is set to 0. In other words, the fuel supply state is restored if the present rotational speed Ne is less than a value obtained by subtracting the hysteresis HYS from the fuel cut-off rpm ncut in a state where the fuel cut-off is present being executed.

In accordance with the illustrated embodiment as described in detail above, when it is determined at the step S18 that the transmission 68 of engine 10 is of the manual type, the ECU 36 responds by reading out the fuel cut-off rpm ncut-M/T for the manual-type transmission as well as the corresponding hysteresis HYS-M/T from the relationships shown in FIG. 3. Thus, a specific operating region for a manual-type automatic transmission is stipulated. When it is determined at the step S18 that the transmission 68 of engine 10 is of the automatic type, on the other hand, the ECU 36 responds by reading out the fuel cut-off rpm ncut-A/T for the automatic-type transmission as well a the corresponding hysteresis HYS-A/T from the relationships shown in FIG. 3 to stipulate a specific operating region for an automatic-type automatic transmission is stipulated.

Here the hysteresis HYS-A/T stipulating the width between the fuel cut-off rpm ncut-A/T and the fuel restoration rpm for the automatic-type transmission is set to be greater than the hysteresis HYS-M/T stipulating the width between the fuel cut-off rpm ncut-M/T and the fuel restoration rpm for the manual-type transmission. Accordingly, it is possible to achieve optimum fuel cut-off control for the purpose of improving fuel consumption in a manual-type transmission and optimum fuel cut-off control for preventing hunting in an automatic-type transmission.

Further, the ECU 36 which executes the aforementioned fuel cut-off control operation need only be of one type. In other words, two types of ECU, one for the automatic-type transmission and one for the manual-type transmission, are no longer required. This makes it possible to realize a reduction in manufacturing cost.

The present invention is not limited to the arrangement of the above-described embodiment but can be modified in various ways without departing from the scope of the claims.

By way of example, in control of an automotive vehicle equipped with a manual-type transmission and an automotive vehicle equipped with an automatic-type transmission, the rotational speeds at which fuel supply is restored are set to be the same and the respective hysteresis HYS are set to as to differ. However, the invention is not limited to such an arrangement, for it is possible to set the respective fuel restoration rpms so as to differ and set the respective fuel cut-off rpms to be the same, or to set the respective fuel restoration rpms to differ as well as the respective fuel cut-off rpms. In short, what is essential is that hysteresis, which is due to a difference between fuel restoration rpm and fuel cut-off rpm, be set smaller in a vehicle equipped with a manual-type transmission than in a vehicle equipped with an automatic-type transmission.

Figure 5:
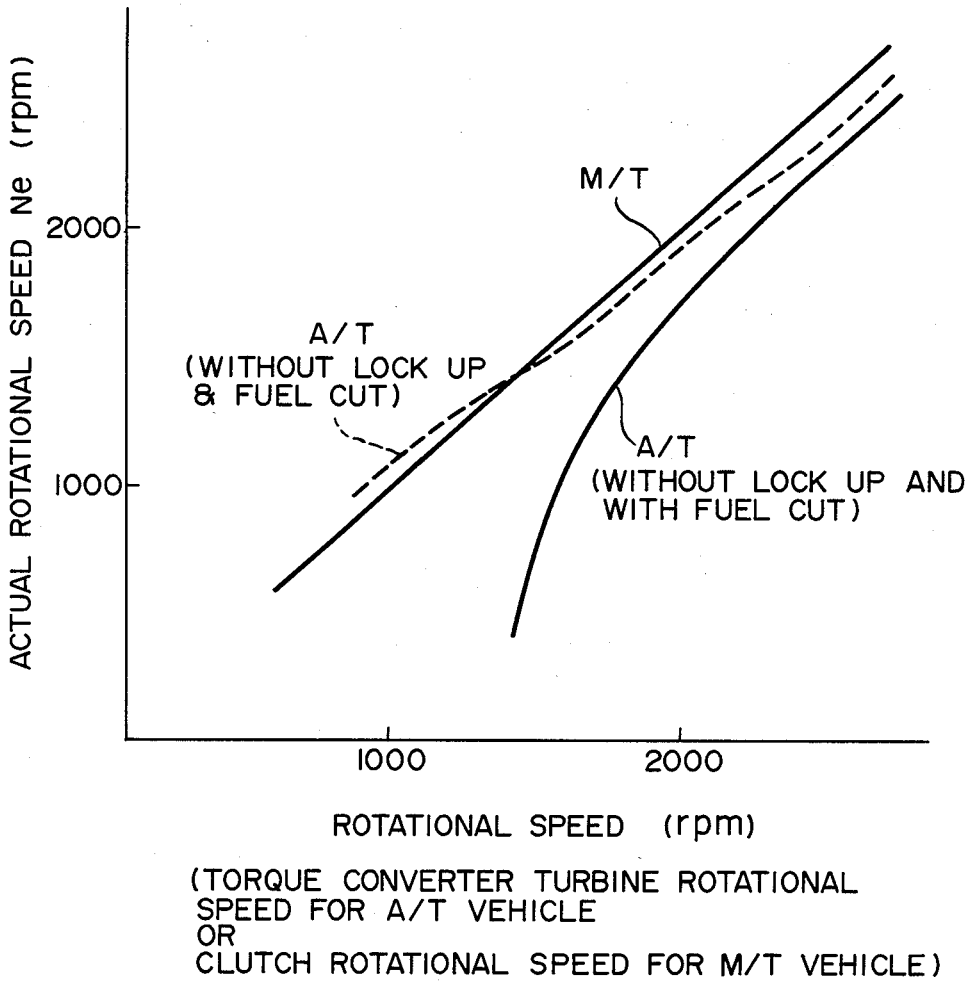
FIG. 5 is a graph showing a change in engine rpm in a state where a throttle valve is fully closed.

Since there is no clutch slip in a manual-type transmission, engine rotational speed is synchronized with the rotational speed of the driven side of the clutch irrespective of whether or not fuel is supplied to the engine, as illustrated in FIG. 5. As a result, it will suffice to set enough hysteresis to prevent hunting of the vehicle body caused by the amount of change in engine torque.

On the other hand, in an automatic-type transmission, the higher the engine rotational speed, the smaller the proportion of the engine rotating driving force that is occupied by driving force due to fuel consumption. At the same time, the larger is the proportion that is occupied by driving force due to the wheels, namely the driving force that rotates the engine when the fuel is being cut-off. As a result, by reducing the hysteresis between the fuel cut-off rpm and fuel restoration rpm by an amount equivalent to this increase in the proportion occupied by the driving force that rotates the engine when the fuel is being cut-off, it is possible to reduce the amount of fluctuation of engine rotation in the operating region in the vicinity of the fuel cut-off region.

What is claimed is:

1. A fuel supply cut-off system for an engine of an automotive vehicle, comprising:

a transmission connected to an output shaft of the engine;

supply means for supplying the engine with a required amount of fuel conforming to the operating state of the engine;

cut-off means for cutting off the supply of fuel by said supply means in a specific operating region of the engine, said specific operating region being a portion of a deceleration region stipulated by values relating to engine load and engine rotational speed;

transmission determination means for determining whether the transmission is of a manual type, in which the output shaft of the engine and wheels of the vehicle are mechanically connected, or of an automatic type, in which the output shaft of the engine and the wheels of the vehicle are connected in a state which allows relative rotation between the output shaft and the wheels; and setting means having, for each of said manual-type transmission and said automatic-type transmission, a fuel cut-off rpm at which the supply of fuel is cut off when sensed engine rpm is greater than said fuel cut-off rpm, and a fuel restoration rpm, which is set to be less than said fuel cut-off rpm, at which the fuel supply is resumed when sensed engine rpm is less than said fuel restoration rpm, said setting means setting, as said specific operating region in which the supply of fuel is cut off, a region in which engine rpm is greater than said fuel cut-off rpm and engine load is less than prescribed;

said setting means changing over said fuel cut-off rpm and said fuel restoration rpm between that for said manual-type transmission and that for said automatic-type transmission in dependence upon the determination made by said determination means; and said setting means setting the width between said fuel cut-off rpm and said fuel restoration rpm for said automatic-type transmission to be greater than the width between said fuel cut-off rpm and said fuel restoration rpm for said manual-type transmission.

2. The system according to claim 1, wherein the engine load that stipulates the specific operating region is set in said setting means to a load at which a throttle valve is fully closed.

3. The system according to claim 2, wherein the width between said fuel cut-off rpm and said fuel restoration rpm for the automatic-type transmission is set to be greater than an amount of decrease in engine rpm at the time of fuel cut-off.

4. The system according to claim 2, further comprising inhibiting means for increasing an amount of intake air for a prescribed period of time immediately after the throttle valve is fully closed, supplying fuel commensurate with an amount of increase in intake air, and inhibiting fuel cut-off at least during a period of time during which the amount of intake air is being increased in a state where gears are engaged.

5. The system according to claim 1, wherein said fuel restoration rpm for said manual-type transmission is set to be the same as said fuel restoration rpm for said automatic-type transmission.

6. The system according to claim 1, wherein said fuel restoration rpm for said automatic-type transmission is set to be greater than said fuel restoration rpm for said manual-type transmission.

7. The system according to claim 6, wherein the width between said fuel cut-off rpm and said fuel restoration rpm for said the automatic-type transmission is set to be greater than an amount of decrease in engine rpm at the time of fuel cut-off.

8. The system according to claim 1, further comprising inhibiting means for inhibiting fuel cut-off when an air conditioner is not operating in a prescribed period of time immediately after the engine is started.

9. The system according to claim 1, wherein said setting means is adapted to set said fuel cut-off rpm and said fuel restoration rpm in dependence upon temperature of engine coolant, with said fuel cut-off rpm and said fuel restoration rpm being set to higher values the lower the temperature of the coolant.

10. The system according to claim 9, wherein the width between said fuel cut-off rpm and said fuel restoration rpm for said the automatic-type transmission is set to be greater than an amount of decrease in engine rpm at the time of fuel cut-off.

11. The system according to claim 9, wherein the higher said fuel cut-off rpm and fuel restoration rpm for said automatic-type transmission are set to be, the smaller the width between said fuel cut-off rpm and said fuel restoration rpm for said the automatic-type transmission is set to be.

* * * * *